US005474163A

United States Patent [19]

West et al.

[11] Patent Number: 5,474,163

[45] Date of Patent: Dec. 12, 1995

[54] SHOE AND UMBRELLA CADDY

[76] Inventors: Lester O. West; Vertie C. West, both of 982 Oakhorne Dr., Harbor City, Calif. 90710

[21] Appl. No.: 191,392

[22] Filed: Feb. 2, 1994

[51] Int. Cl.[6] ..... A45C 3/12; A45C 13/40

[52] U.S. Cl. ..... 190/102; 190/109; 294/146

[58] Field of Search ..... 294/137, 141–143, 294/138, 146, 149, 165; 150/107, 112; 190/102, 109, 112, 113, 115, 124; 206/278; 224/915; 383/40, 100, 103

[56] References Cited

U.S. PATENT DOCUMENTS

| | | | |
|---|---|---|---|
| 1,251,404 | 12/1917 | Mills | 383/103 X |
| 2,481,565 | 9/1949 | Boretz | 190/109 |
| 2,781,113 | 2/1957 | Seeman | 190/102 |
| 3,495,760 | 2/1970 | Poth . | |
| 4,113,159 | 9/1978 | Allsop . | |
| 4,453,623 | 6/1984 | Horii | 190/102 |
| 4,669,772 | 6/1987 | Waller, Jr. . | |
| 4,817,188 | 3/1989 | Van Erden . | |
| 4,973,096 | 11/1990 | Joyce . | |
| 5,004,134 | 4/1991 | Barry | 224/915 X |
| 5,228,547 | 7/1993 | Yoo | 190/109 X |

*Primary Examiner*—Johnny D. Cherry

[57] ABSTRACT

A container housing includes a zippered front wall for access to the container housing cavity, with support straps arranged for ease of manual manipulation and support of the container housing. The housing further includes a housing first side wall upon which a support loop spaced from a support flange is mounted. The support loop includes a loop opening coaxially aligned with a flange opening to receive and position an umbrella therealong. The invention employs ventilation openings to enhance ventilation through the container during storage for prolonged periods.

4 Claims, 2 Drawing Sheets

SHOE AND UMBRELLA CADDY

BACKGROUND OF THE INVENTION

1. Field of the Invention

The field of invention relates to storage container structure, and more particularly pertains to a new shoe and umbrella caddy wherein the same is arranged for the ease of transport and storage of shoe and umbrella structure.

2. Description of the Prior Art

Typically, a person transports substitute shoes for use during a rainy day when an individual may wish to preserve other shoes for indoor use only. Such substitute shoes are typically carried by hand or within a bag in a somewhat unorganized manner. Therefore, various types of carriers have been devised to transport such substitute shoes.

Prior art shoe caddy structure is indicated U.S. Pat. Nos. 4,669,772; 4,113,159; 3,495,760; 4,817,188; and 4,973,096.

The instant invention attempts to overcome deficiencies of the prior art by providing for a shoe and umbrella caddy organization permitting the individual to employ alternate shoes in association with an umbrella for use during inclement weather and in this respect, the present invention substantially fulfills this need.

SUMMARY OF THE INVENTION

In view of the disadvantages inherent in the known types of caddy apparatus now present in the prior art, the present invention provides a shoe and umbrella caddy wherein the same is arranged for ease of transport of an individual's shoes and associated umbrella structure. As such, the general purpose of the present invention, which will be described subsequently in greater detail, is to provide a new shoe and umbrella caddy apparatus and method which has many of the advantages of the prior art listed heretofore and many novel features that result in a shoe and umbrella caddy apparatus which is not anticipated, rendered obvious, suggested, or even implied by any of the prior art, either alone or in any combination thereof.

To attain this, the present invention provides a container housing includes a zippered front wall for access to the container housing cavity, with support straps arranged for ease of manual manipulation and support of the container housing. The housing further includes a housing first side wall upon which a support loop spaced from a support flange is mounted. The support loop includes a loop opening coaxially aligned with a flange opening to receive and position an umbrella therealong. The invention employs ventilation openings to enhance ventilation through the container during storage for prolonged periods.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical the application. The abstract is neither intended to define the invention of the application, which is measured by the claims, nor is it intended to be limiting as to the scope of the invention in any way.

It is therefore an object of the present invention to provide a new shoe and umbrella caddy apparatus and method which has many of the advantages of the prior art listed heretofore and many novel features that result in a shoe and umbrella caddy apparatus which is not anticipated, rendered obvious, suggested, or even implied by any of the prior art, either alone or in any combination thereof.

It is another object of the present invention to provide a new shoe and umbrella caddy which may be easily and efficiently manufactured and marketed.

It is a further object of the present invention to provide a new shoe and umbrella caddy which is of a durable and reliable construction.

An even further object of the present invention is to provide a new shoe and umbrella caddy which is susceptible of a low cost of manufacture with regard to both materials and labor, and which accordingly is then susceptible of low prices of sale to the consuming public, thereby making such shoe and umbrella caddies economically available to the buying public.

Still yet another object of the present invention is to provide a new shoe and umbrella caddy which provides in the apparatuses and methods of the prior art some of the advantages thereof, while simultaneously overcoming some of the disadvantages normally associated therewith.

An even further object of the present invention is to provide a new shoe and umbrella caddy which provides a container housing includes a zippered front wall for access to the container housing cavity, with support straps arranged for ease of manual manipulation and support of the container housing.

Still yet another object of the present invention is to provide a new shoe and umbrella caddy which further includes a housing first side wall upon which a support loop spaced from a support flange is mounted and wherein the support loop includes a loop opening coaxially aligned with a flange opening to receive and position an umbrella therealong.

Yet still another object of the present invention is to provide a new shoe and umbrella caddy which includes ventilation openings to enhance ventilation through the caddy during storage for prolonged periods.

These together with other objects of the invention, along with the various features of novelty which characterize the invention, are pointed out with particularity in the claims annexed to and forming a part of this disclosure. For a better understanding of the invention, its operating advantages and the specific objects attained by its uses. Reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
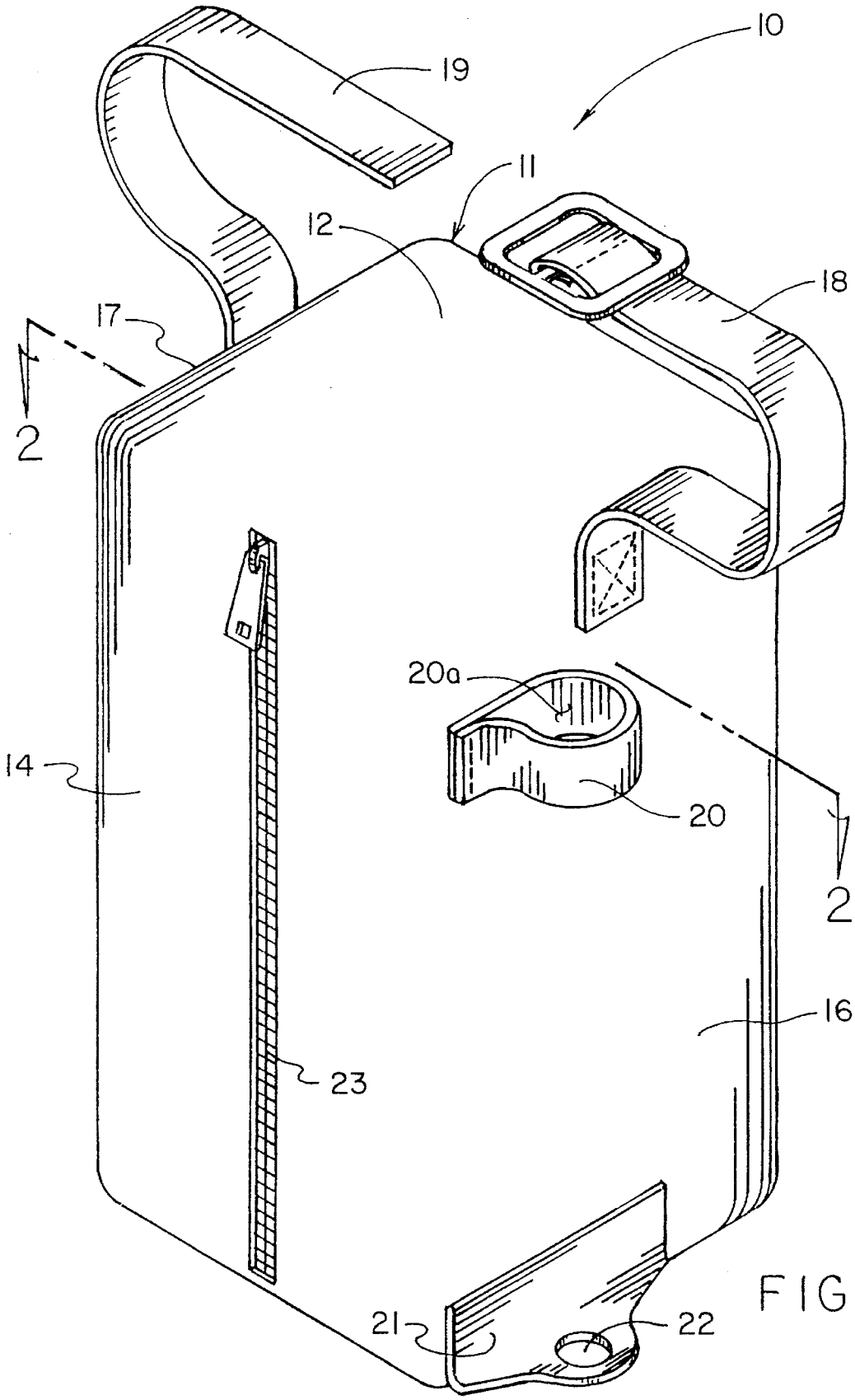
FIG. 1 is an isometric illustration of the invention.
Figure 2:
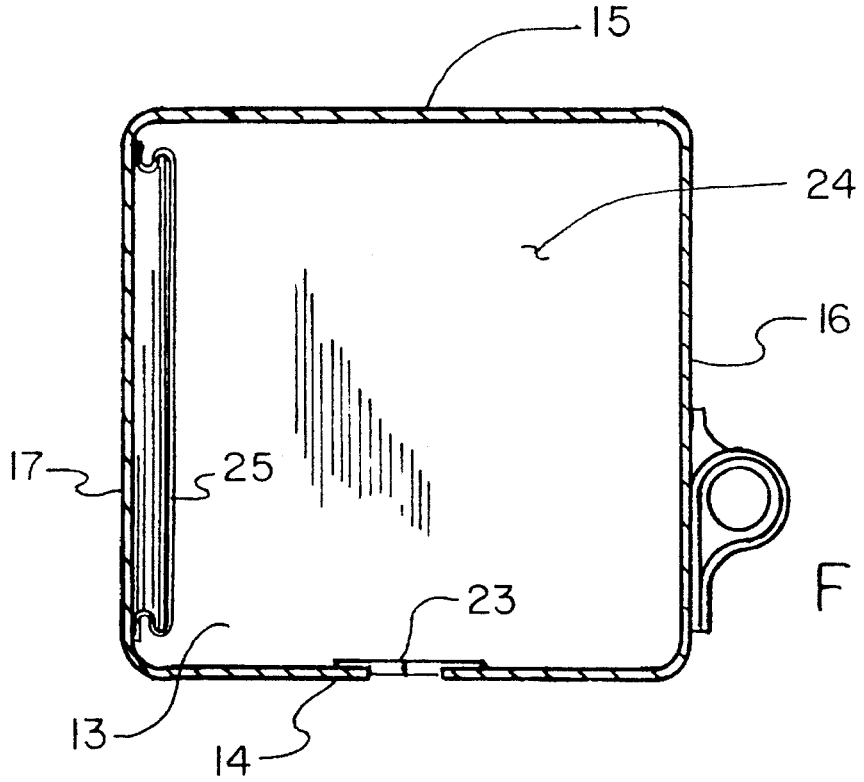
FIG. 2 is a cross sectional view, taken along lines 2—2 of FIG. 1 in the direction indicated by the arrows.
Figure 3:
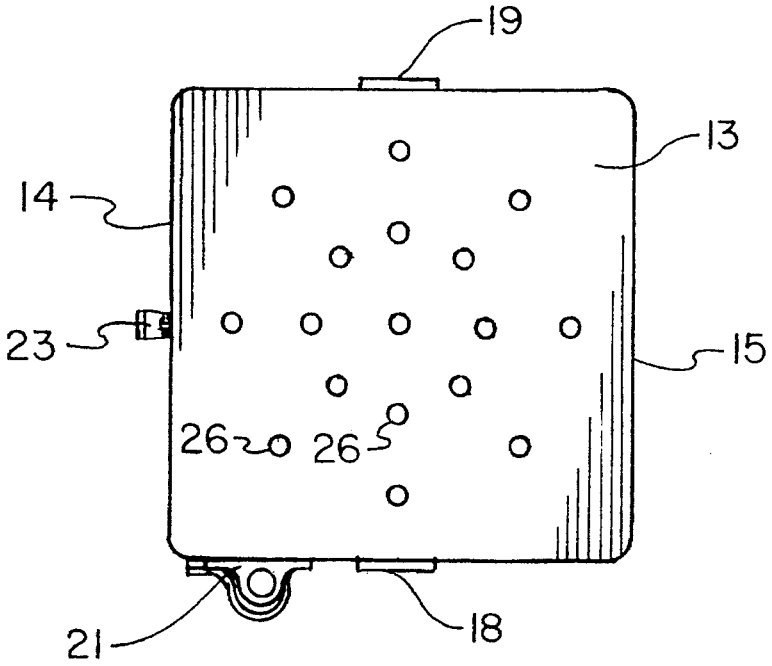
FIG. 3 is a bottom plan view of the invention.

With reference now to the drawings, and in particular to FIGS. 1–3 thereof, a new shoe and umbrella caddy embodying the principles and concepts of the present invention and generally designated by the reference numeral 10 will be described.

More specifically, the shoe and umbrella caddy 10 of the instant invention comprises a container housing 11 having a top wall 12 spaced from a bottom wall 13, a front wall 14 spaced from a rear wall 15, with first and second respective side walls 16 and 17 arranged in surrounding relationship relative to a housing cavity 24 (see FIG. 2). It should be noted that the front wall includes a zipper 23 for access within the container housing 11, and more specifically to the housing cavity 24, as illustrated in FIG. 4 for example.

The respective first and second side walls 16 and 17 mount respective first and second straps 18 and 19 extending therefrom and arranged for securement relative to one another utilizing conventional fastening structure such as a buckle, hook and loop fastener structure, or the like. A support loop 20 is secured to the first side wall 16 adjacent the top wall 12, with a support flange 21 secured to the first side wall 16 adjacent the bottom wall 13. The support loop includes a support loop opening 20*a*, while the support flange includes a flange aperture 22, with the flange aperture is coaxially aligned with the support loop opening to receive an umbrella in a vertical manner between the support loop and the support flange. The flange aperture 22 should be no larger than is necessary to receive the tip of an umbrella snugly therewithin so that the fabric of the umbrella is not permitted to engage the flange 21 which could result in possible damage thereto.

As illustrated in FIG. 2, the housing cavity 24 may contain a pocket 25 to position various components such as spare shoe laces, coins, and the like for transport by an individual or storage until need dictates access to such components within the pocket. In the preferred embodiment of the present invention, the pocket is coextensive with the side wall 17.

To provide for ventilation within the housing cavity 24, a plurality of ventilation holes 26 are provided extending through the bottom wall 13, as best illustrated in FIG. 3. The ventilation holes 26 are arranged to permit the intrusion of air within the cavity 24, while precluding the entrance of falling rain. More specifically, it is important that the ventilation holes be positioned within the bottom wall 13 only such that the caddy 10 may be carried in a rain downpour without the contents therewithin being adversely affected by contact with the rain.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe and umbrella caddy comprising:

a container housing having a top wall spaced from a bottom wall, a front wall spaced from a rear wall, a first side wall spaced from a second side wall, with a zipper directed vertically along the front wall, with the container housing having a cavity therewithin accessed through the zipper;

strap means mounted to the container housing for ease of transport of the container housing;

a support loop fixedly secured to the first side wall adjacent the top wall, the support loop having a support loop opening;

a support flange fixedly secured to the first side wall adjacent the bottom wall, the support flange having a flange aperture directed therethrough, with the support loop opening coaxially aligned with the flange aperture to receive an umbrella through the support loop and the flange aperture.

2. The caddy as set forth in claim 1, wherein the bottom wall exclusively includes ventilation holes directed therethrough.

3. The caddy as set forth in claim 2, and further comprising a pocket coupled to and arranged coextensive with one of the side walls within the housing cavity.

4. The caddy as set forth in claim 1, wherein said support loop comprises an elongate strap member having one end attached to said first side wall and having an opposed end, said opposed end said one end and said first side wall coextensive therewith being fastened together to form said support loop.

* * * * *